United States Patent [19]

Orlandi

[11] Patent Number: 5,004,517

[45] Date of Patent: Apr. 2, 1991

[54] DEVICE FOR THE ALIGNMENT OF BOTTLES PROVIDED WITH A REFERENCE MOLDING IN ROTARY LABELING MACHINERY

[75] Inventor: Ireneo Orlandi, San Giorgio Di Mantova, Italy

[73] Assignee: Alfa Costruzioni Meccaniche S.p.A., Mantova, Italy

[21] Appl. No.: 437,076

[22] Filed: Nov. 14, 1989

[30] Foreign Application Priority Data

Dec. 14, 1988 [IT] Italy ..... 40182 A/88

[51] Int. Cl.[5] ..... B65C 9/00

[52] U.S. Cl. ..... 156/567; 156/538; 156/DIG. 26

[58] Field of Search ..... 156/538, 552, 566, 567, 156/569, DIG. 25, DIG. 26; 198/481.1

[56] References Cited

U.S. PATENT DOCUMENTS 4,414,056 11/1983 Buchholz et al. ..... 156/567 X
4,467,909 8/1984 Jorss ..... 156/567 X
4,468,277 8/1984 Kontz ..... 156/567

FOREIGN PATENT DOCUMENTS 3015595 11/1980 Fed. Rep. of Germany ..... 156/567

*Primary Examiner*—William A. Powell
*Attorney, Agent, or Firm*—Darby & Darby

[57] ABSTRACT

The device is designed to interact with a reference notch or projection (2) molded into bottles, and is applicable to rotary labeling units incorporating a turntable with a number of dishes (3) individually rotatable about vertical axes, on which the bottles are positioned in readiness for labeling; each dish operates in conjunction with a mechanical stop (18) capable of alternating between an at-rest position, and a position in which it engages the reference molding afforded by the bottle.

4 Claims, 3 Drawing Sheets

DEVICE FOR THE ALIGNMENT OF BOTTLES PROVIDED WITH A REFERENCE MOLDING IN ROTARY LABELING MACHINERY

BACKGROUND OF THE INVENTION

The invention relates to a device by means of which to align bottles provided with reference moldings, for use with rotary type labeling machine. High speed labeling machines conventionally afford a revolving platter or turntable incorporating a plurality of equispaced peripheral dishes on which bottles are carried and positioned for labeling. In operation, the revolving turntable is rotated through one or more labeling stations, at which single labels drawn from a magazine are gummed and transferred to the bottle, respectively.

The dishes, onto which the unlabeled bottles are transferred by a conventional star wheel conveying device, are in turn individually rotatable about their vertical axes.

Each label must be applied to the respective bottle in alignment with a reference, embodied as a notch or projection offered by the lateral surface of the bottle itself, generally at bottom; in short, the label must be pasted to the bottle at a prescribed position in relation to the notch, or other molded reference.

The prior art embraces two methods of aligning the bottle in relation to the gummed label, of which one involves effecting the alignment as the bottle passes through the star wheel device, prior to its entry onto the turntable. In this first method of alignment, a photocell is used to operate friction or gripping means that stop and hold the rotating bottle on arrival at a given angular position.

The second method, which is entirely mechanical and consists similarly in positioning the bottle during its passage through the star wheel entry station, makes use of a mechanical device that engages the bottle directly when in a predetermined position. In both the electrical and mechanical systems thus outlines, one has the drawback that the bottle is transferred from the star wheel to the turntable without the aid of any constraining or clamping action, and is therefore free to rotate about its own axis; the result is that correct alignment of the bottle, hence correct positioning of the label, can no longer be guaranteed.

The object of the present invention is to overcome the drawbacks aforementioned, and in particular, to effect alignment of the bottle in a position such as will disallow further movement in relation to the labeling components and thus ensure faultless positioning of the label in relation to a reference incorporated into the bottle.

SUMMARY OF THE INVENTION

The stated object is realized with the device to which the present invention relates, which serves to effect the alignment of bottles provided with a molded reference mark, and is intended for use in rotary labeling machines of the type comprising a revolving turntable with equispaced peripheral dishes, each rotatable about a vertical axis, onto which single bottles for labeling are transferred; such a device comprises a mechanical stop, capable of alternating movement between an at-rest position and a position of engagement with a reference mark afforded by each successive bottle occupying the rotatable dish, and mechanical means by which to produce the alternating movement of the mechanical stop each time a bottle is presented in readiness for alignment.

BRIEF DESCRIPTION OF THE DRAWINGS

The invention will now be described in detail, by way of example, with the aid of the accompanying drawing, in which.

DESCRIPTION OF THE PREFERRED EMBODIMENTS

Figure 1:
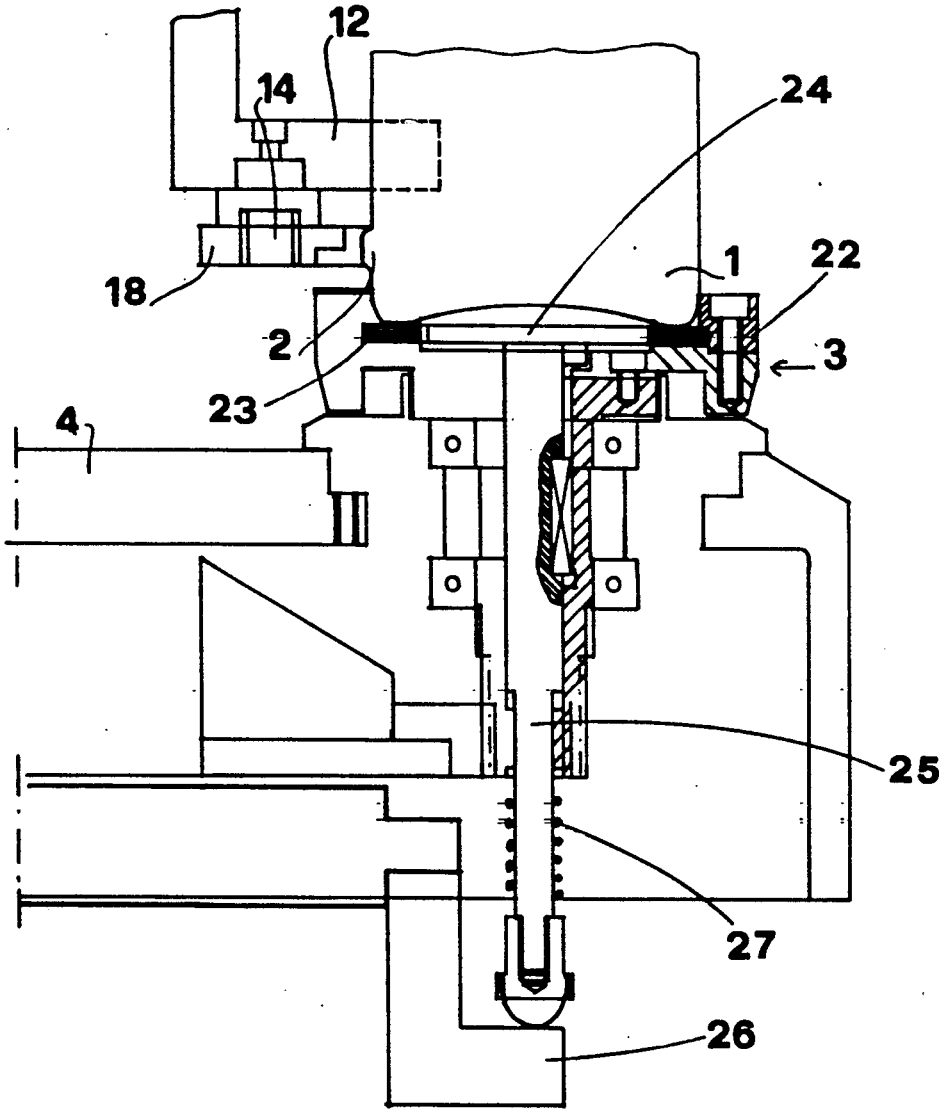
FIG. 1 is an elevation illustrating one part of the bottle alignment device, seen partly in section and with the stop in the engagement position.
Figure 2:
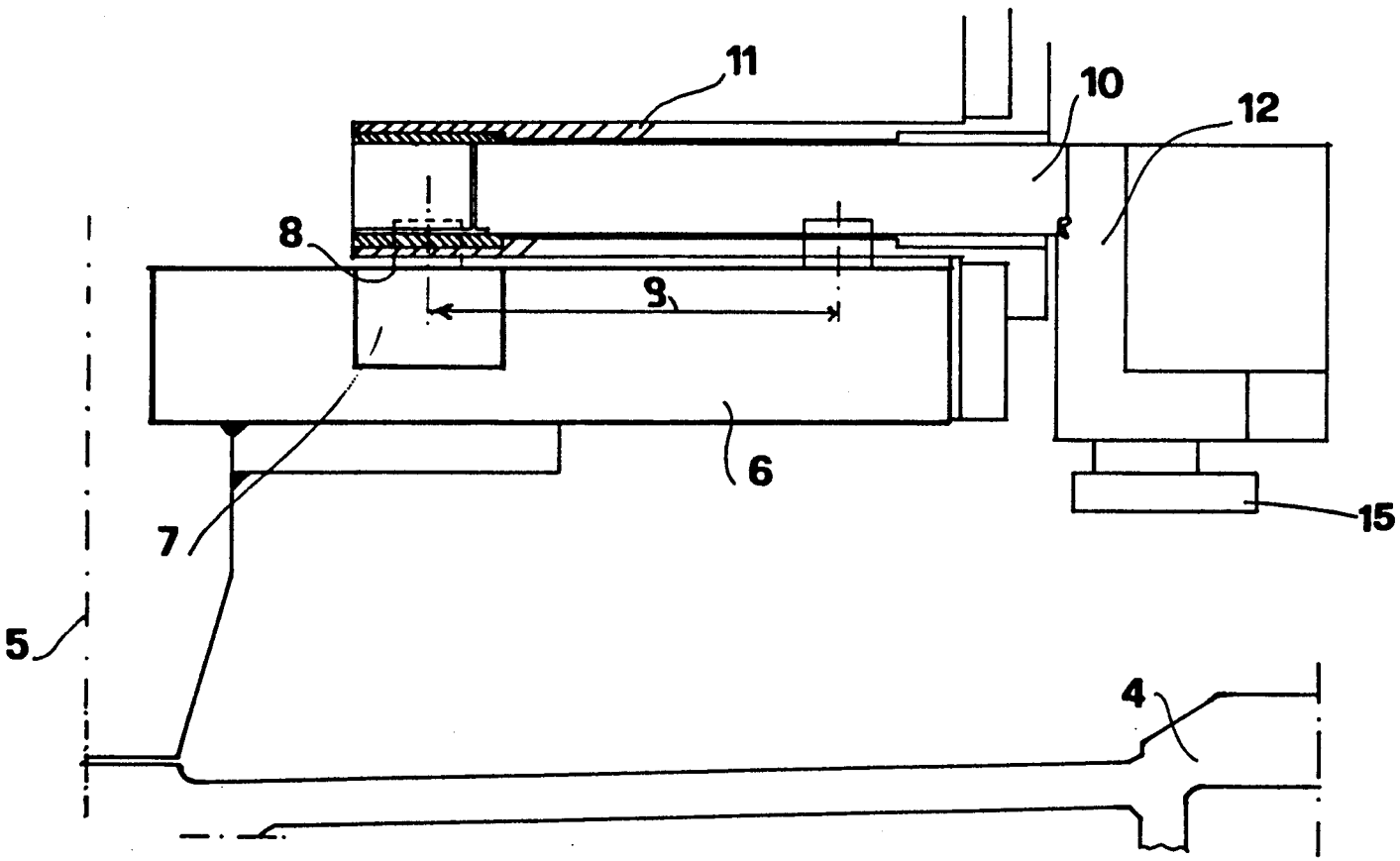
FIG. 2 shows the remaining part of the device from the same aspect as that of FIG. 1, with the stop in the at-rest position.

With reference to FIG. 1 of the drawings, 1 denotes a bottle affording a positive reference 2, which in the example illustrated is a molded projection. 3 denotes one of a plurality of dishes on which the single bottles for labeling are positioned.

The dishes 3 are carried by a circular turntable 4, rotatable about a vertical axis denoted 5. 6 denotes a plate, rigidly associated and rotatable as one with the turntable, incorporating a sunken cam profile 7 in which a follower 8 is insertable; the length of the profile is such as to afford the follower 8 freedom of movement through a distance denoted 9.

The follower 8, which takes the form of a pin and roller, is rigidly attached to the sliding rod 10 of a cylinder 11.

Figure 3:
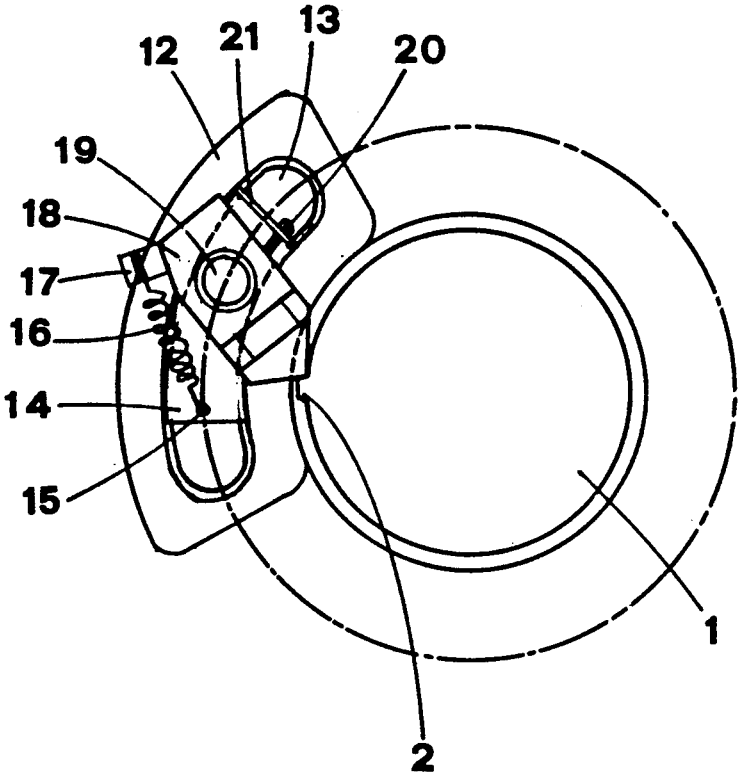
FIG. 3 is a detail of the device, viewed in plan.

Also attached rigidly to the rod 10 is a contoured plate 12, exhibiting a curvature complementary to the side wall of the bottle 3, as shown in FIG. 3. The contoured plate 12 is provided with a slot 13 in the shape of an arc to a circle, accommodating a slide 14 carrying a vertical pin 15 to which one end of a spring 16 is anchored; the remaining end of the spring is attached to a screw 17, rigidly associated with a rotatable stop 18. More exactly, the stop 18 is mounted to a pivot 19 located at an intermediate point along its length, and drawn by the action of the spring 16 in a counterclockwise direction, as viewed in FIG. 3. The resulting biased rotational movement of the stop 18 is limited by a setscrew 20, carried in a plate 21, of which the point engages the side of the stop 18 opposite from the spring 16, with respect to the pivot 19. Thus, the setscrew 20 permits of adjusting the position of the stop 18 in relation to the projection 2 afforded by the bottle.

The single dish 3 consists in an annular skirt 22 internally of which the bottle 1 is inserted to a depth at which its base comes to rest on a rubber ring 23, anchored firmly inside the skirt.

24 denotes a circular rest carried by a rotatable rod 25 capable of reciprocating vertically through the space afforded by the rubber ring 22, which is raised by a cam 26 against the action of a return spring 27 loaded in such a way as to bias the rod downward against the surface of the cam.

The upward movement of the circular rest 24 comes about as the dish 3, carrying the bottle, rotates during the alignment stage, i.e. to the point where the projection 2 locates against the stop 18.

This accomplished, the rest 24 is lowered, and the bottle 1 remains stably positioned on the rubber ring 22, held fast by frictional contact and thus prevented from rotating out of alignment during its subsequent passage to the labeling station.

What is claimed is:

1. A device for the alignment of bottles incorporating a positively engageable reference (2), in rotary labeling machines, comprising:

a circular turntable, rotatable about a vertical axis, a plurality of peripheral dishes (3) distributed uniformly about the periphery of the circular turntable, each rotatable about a vertical axis;

a mechanical stop (18) capable of alternating movement between an at-rest position and a position of engagement with the reference (2) afforded by a bottle occupying one of the rotatable dishes (3);

mechanical means by which to produce alternating movement of the mechanical stop each time a bottle is presented on one of the rotatable dishes.

2. A device as in claim 1, wherein the mechanical means by which to produce alternating movement of the mechanical stop (18) comprise a cam profile (7) afforded by a plate (6) rigidly associated with the turntable, and a follower (8), freely accommodated by the profile and rigidly attached to the rod (10) of a cylinder (11) that carries the stop (18).

3. A device as in claim 1, wherein the stop (18) is pivoted at an intermediate point along its length, and associated with a slotted contoured plate (12) accommodating a slide (14) that carries spring means (16) serving to bias the stop in a counterclockwise direction, and with a setscrew (20) by means of which to counteract the spring bias and permit of adjusting the position of the stop (18) in relation to the reference (2) afforded by the bottle.

4. A device as in claim 1, wherein the single dish (3) comprises an annular skirt (22) internally of which the base of a bottle for labeling is insertable, a rubber ring (23) located internally of the skirt, with which the bottom of the bottle engages in direct contact, and a circular rest (24) insertable through and capable of reciprocating in relation to the rubber ring, by which the bottle is raised for the purposes of effecting alignment.

* * * * *